US005113913A

United States Patent [19]

Graf

[11] Patent Number: 5,113,913

[45] Date of Patent: May 19, 1992

[54] TOGGLE TYPE CLAMP FOR COUPLING A HEDDLE FRAME TO A FRAME HOLDER

[75] Inventor: Martin Graf, Horgenberg, Switzerland

[73] Assignee: Grob & Co. Aktiengesellschaft, Horgen, Switzerland

[21] Appl. No.: 638,807

[22] Filed: Jan. 8, 1991

[51] Int. Cl.[5] ..... D03C 9/06

[52] U.S. Cl. ..... 139/91; 139/88; 24/450; 248/225.31

[58] Field of Search ..... 139/92, 93, 91, 82, 139/83, 87, 88; 24/573.1, 490; 248/231.3, 225.31

[56] References Cited

U.S. PATENT DOCUMENTS 4,015,639 4/1977 Koch ..... 139/92
4,715,409 12/1987 Graft ..... 139/88

FOREIGN PATENT DOCUMENTS 0295189 12/1989 European Pat. Off. ..... 139/91
1166108 3/1964 Fed. Rep. of Germany .

*Primary Examiner*—Andrew M. Falik
*Attorney, Agent, or Firm*—Nies, Kurz, Bergert & Tamburro

[57] ABSTRACT

A frame holder to which a heddle frame is coupled by a fastener operating in accordance with the toggle lever principle and pivotably mounted at the upper end of the frame holder by means of a pivot axis. The fastener includes a lever, consisting of two parallel levers, which is pivotable around a first pivot axis whereby an operating lever is pivotably mounted to its other end at a second pivot axis. A bolt which is pivotably arranged on this axis is located in the operating lever which is structured as a hollow rod. Due to elongate holes formed in the hollow rod and through which the axis extends the hollow rod is longitudinally displaceable relative to the bolt. The hollow rod is pressed somewhat towards the outside under action of a pressure spring which rests against a nut screwed onto the end of the bolt and against a inner sleeve of the hollow rod and is installed in a pre-stressed state when a wedge-like designed push button arranged at the front end of the hollow rod upon a pivoting of the fastener into the locking position engages into a detent recess at a formed piece bolted to the side support. In this way the side support and the frame holder equipped with the pivotable fastener are pressed together whereby an over dead center position is arrived at in the end position of the fastener. The apparatus allows with the aid of this snap closure a fast coupling and uncoupling of the heddle frame and frame holder and replaces the customary screw bolt fasteners.

12 Claims, 4 Drawing Sheets

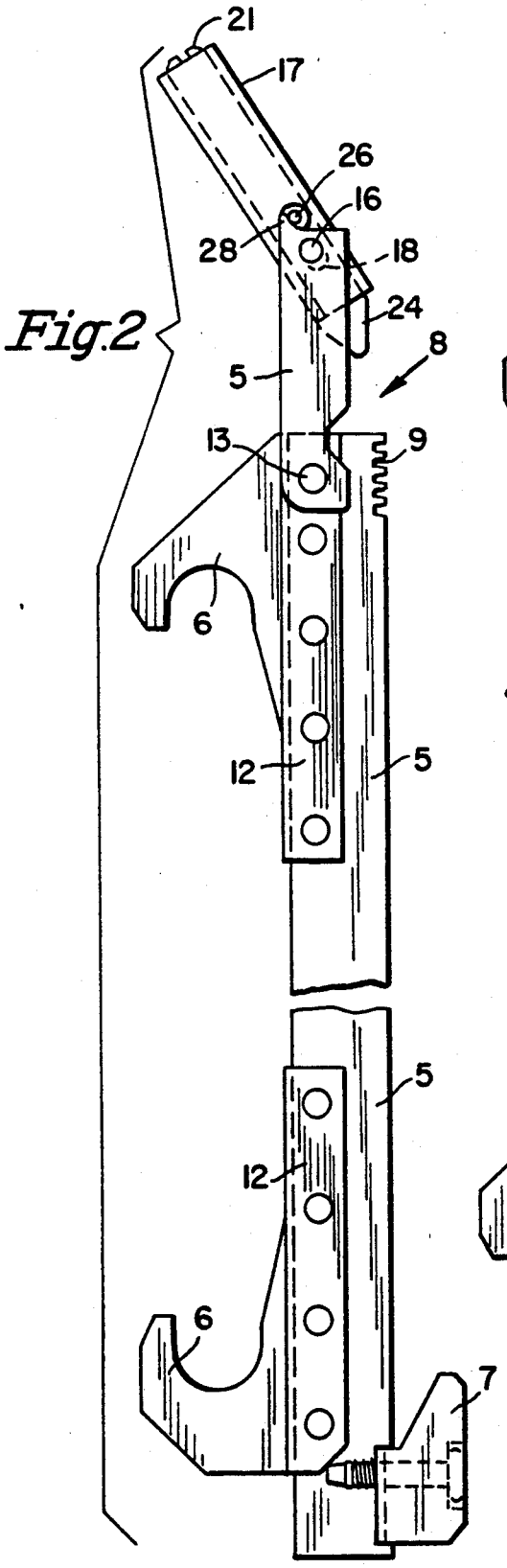
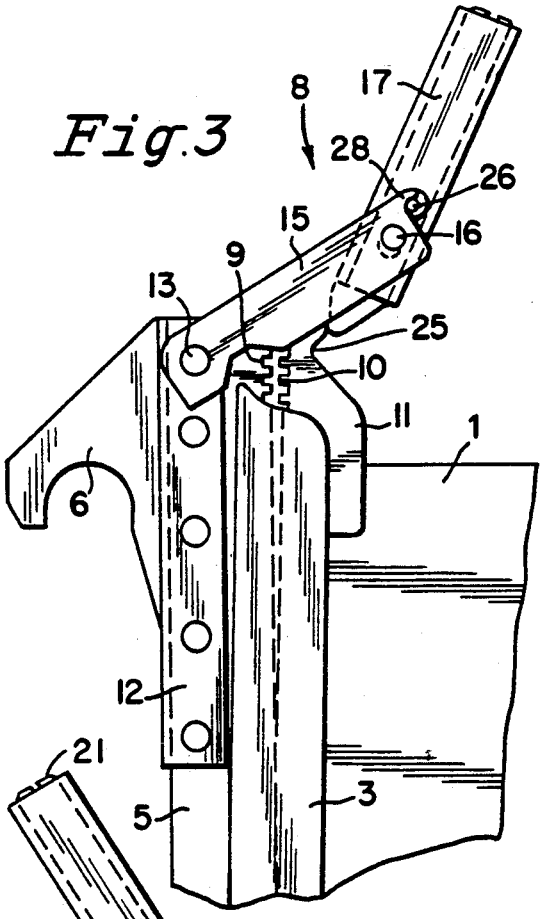
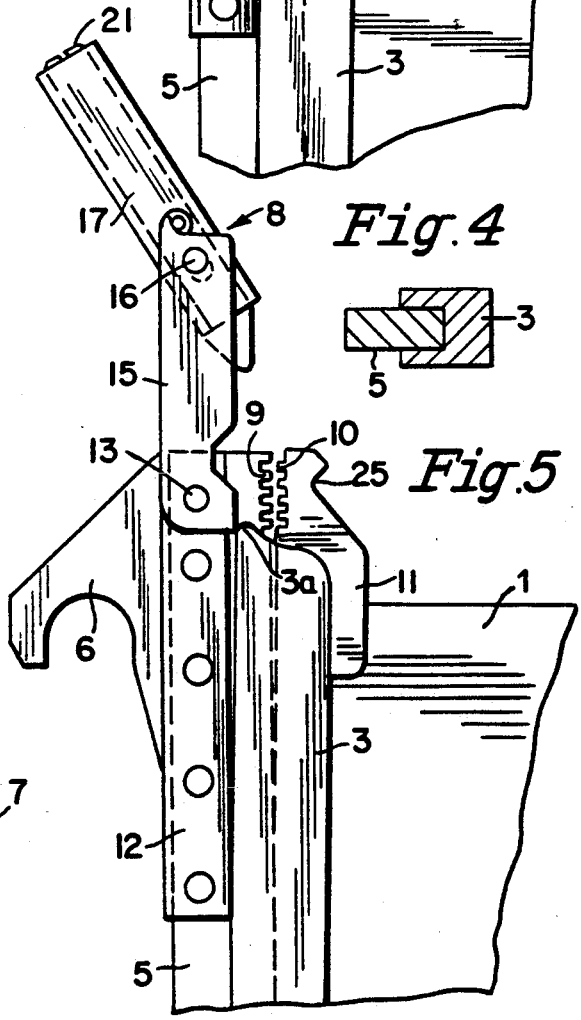
Fig.5

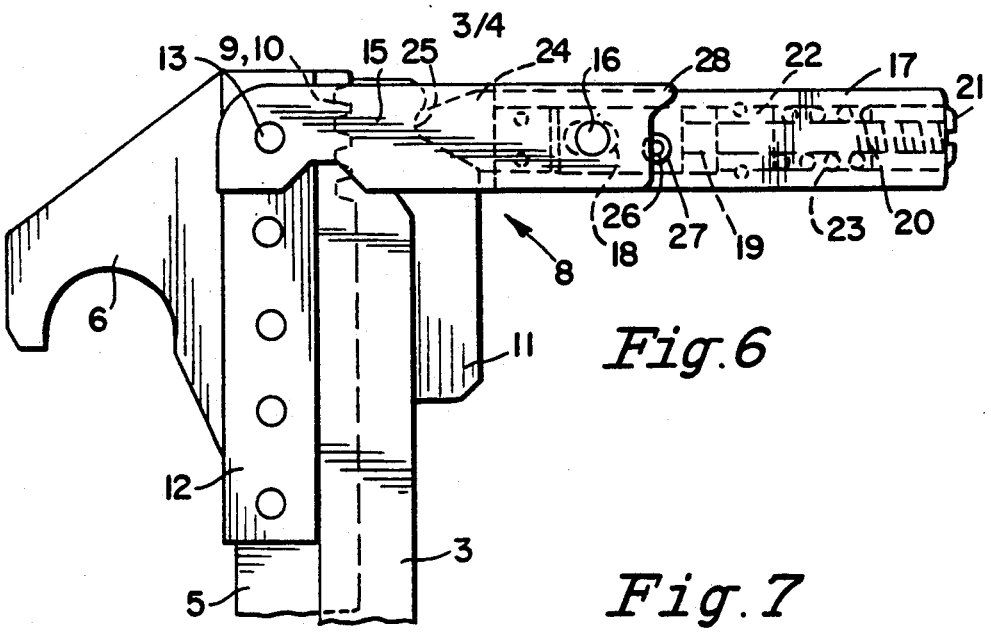
Fig. 6
Fig. 7
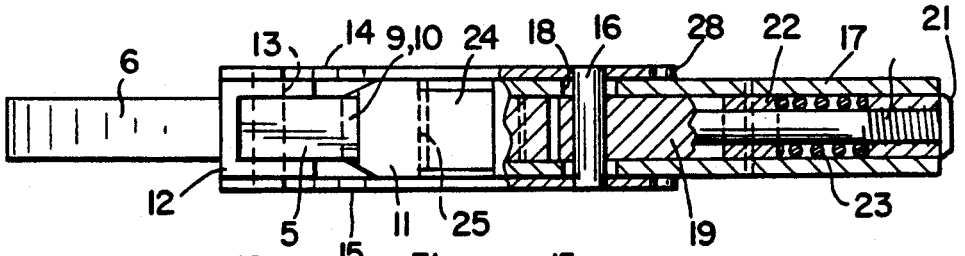
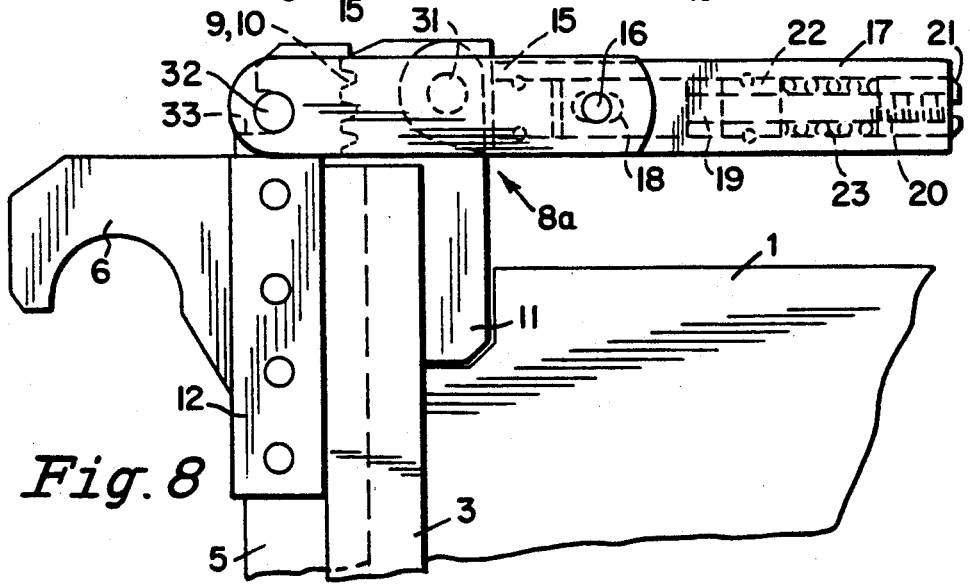
Fig. 8
Fig. 9
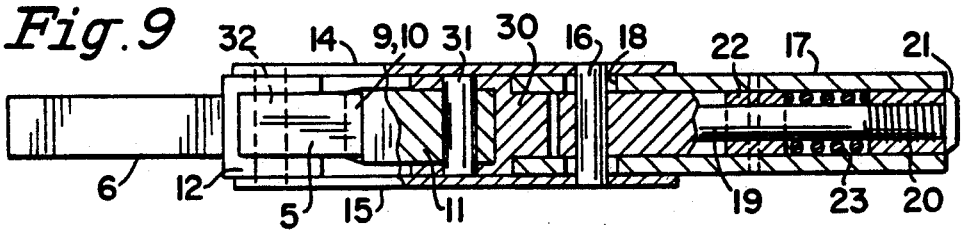

TOGGLE TYPE CLAMP FOR COUPLING A HEDDLE FRAME TO A FRAME HOLDER

BACKGROUND OF THE INVENTION

1. Field of the Invention

The invention relates to an apparatus for coupling a heddle frame to respective frame holders each extending along the side of the side supports of the heddle frame and movable upwards and downwards by means of coupling devices which are arrestable by application of the toggle lever-principle.

2. Description of the Prior Art

The heddle frame of a apparatus for coupling a heddle frame to a frame holder disclosed in the German Published Patent Application Nr. 1 166 108 includes at its side support a upper and lower cam for which reason the frame holder must posess accordingly also two counter cams cooperating with mentioned cams, and the frame holder must include therefore a special structure suitable for the bracing of the cams located at a distance from each other and thus occupying the entire height of the frame holder. The bracing by the application of the toggle switch principle proceeds, therefore, also in the vertical direction connecting the two cams, in which direction, however, the heddle frames move oscillatingly in operation, too. At the bracing device active in the vertical direction and application of the toggle switch principle obviously no spring force takes part. Because extremely large forces occur in the vertical direction of movement in modern high-speed weaving machines the here applied principle of the bracing device in the same direction is quite unsuitable. Furthermore, the bracing device brought to act in the vertical direction necessitates a demand of space for the bracing arms which extends above the heddle frame a considerable distance upwards, which space is generally not available at the weaving machines presently in operation.

SUMMARY OF THE INVENTION

It is an object of the invention to provide a technically improved solution for the interconnecting of the heddle frame and the frame holder, a suitable apparatus for coupling same with little space requirements specifically above the heddle frame, in which the pressing on force acts laterally relative to the oscillating direction of movement of the heddle frames and to keep limited areas of heddle frame and frame holder pressed together in a form-locked state by the mentioned force such that no relative movement between the parts in the direction of their upwards and downwards movement is possible.

A further object is to provide an apparatus which enables as little as possible structurally to be changed at a common heddle frame, such that specifically no laterally projecting cams must be present and such that finally the coupling between heddle frame and frame holder can be effected quickly and with one motion.

Still a further object is to provide an apparatus in which a lock pivotably mounted to the end of the frame holder or the edge of the heddle frame includes an operating lever containing a spring, and a lever connecting member pivotably mounted to the operating lever and engaging the frame holder, which levers are pivotable at a tensioning of the spring according to the toggle lever principle into a over-center position in which they keep form locking coupling members present at the frame holder and the side support of the frame stave pressed together by a spring force acting perpendicularly relative to the up and down movement of the frame holder.

Yet a further object is to provide an apparatus having a lock which can be operated quickly and by a handle, whereby the operating lever of the lock extends parallel to and somewhat above the upper edge of the heddle frame.

A further object is to provide an apparatus in which the heddle frame has no laterally projecting parts and includes merely at the inner side a detent recess for the toggle lever and follower surfaces for the form locked coupling to the frame holder.

A further object is to provide an apparatus in which the pressing against force caused by the toggle-lever bracing device is directed perpendicularly to the up and down movement of the oscillatingly moved heddle frame.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a fragmentary view that illustrates the upper and lower end of a frame holder on an enlarged scale;

FIG. 3 is an enlarged fragmentary view that illustrates the upper end of the frame holder in connection with the only partly illustrated heddle frame;

FIG. 4 is a cross-sectional view through the frame holder and the side support of the heddle frame shown in FIG. 3;

FIG. 5 is an enlarged fragmentary view similar to FIG. 3 that illustrates the upper part of the frame holder in a different position of the fastener;

FIG. 6 is an enlarged fragmentary view similar to FIG. 3 that illustrates the upper part of the frame holder in the locked position with the side support;

FIG. 7 is a top view partially broken away and partially in section of the part of the apparatus shown in FIG. 6;

FIGS. 8 and 9 are a side view and a top view of a modified embodiment of the apparatus;

DESCRIPTION OF THE PREFERRED EMBODIMENT

Figure 1:
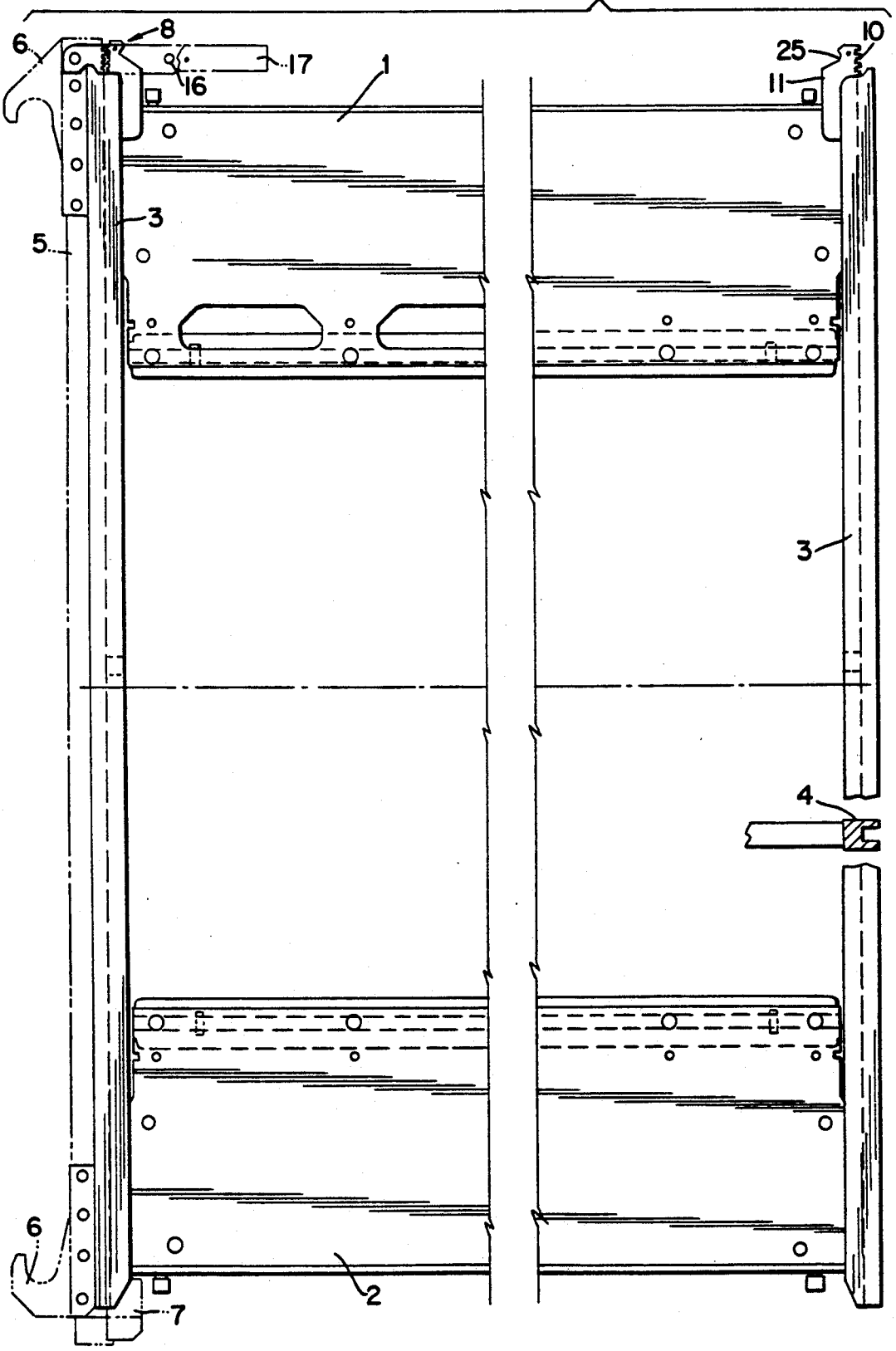
FIG. 1 is an elevational view that illustrates the left and right end sections of a heddle frame, with only one holder illustrated with broken lines at the left side.

The heddle frame according to FIG. 1 consists of an upper frame stave 1 and a lower frame stave 2 as well as of two side supports 3 and 4 which form together a rectangularly shaped frame. The frame staves 1 and 2 illustrated in FIG. 1 only in part of their length have in a frame stave of this kind a length of several meters. The side supports 3 and 4 have a U-shaped cross-section. A frame holder 5 of a rectangular cross-section fits into mentioned cross-section between the two legs and is illustrated by broken lines in FIG. 1 at the left side.

Such a frame holder 5 is to be mounted to the heddle frame at the left as well as at the right side and serves for the upwards and downwards moving of the heddle frame in the weaving machine whereby not illustrated pulling means act onto the hooks 6 at the upper and at the lower end of the frame holder. A jaw 7 having a inclined surface is bolted onto the lower end of the frame holder 5 by means of which the frame holder 5 engages behind the bevelled lower end of the side support in a hook-like fashion.

In order to couple the frame holder 5 to the side support of the frame use is made of the fastener located at the upper end of the frame holder and operating in accordance with the toggle lever principle and is illustrated in FIGS. 2, 3, 5 and 6 in various positions. FIG. 4 reveals that the side supports 3 and 4 are each shaped to have a U-shaped cross-section and the frame holder has a rectangular cross-section and projects between the legs of the U.

In order to better transmit the large forces from the frame holder onto each of the side supports 3 and 4, entrainment surfaces in form of a section of a serrated slat 9 and extending laterally relative to the direction of drive of the oscillatingly movable frame holder 5 are formed at the upper end of the frame holder 5 and in the form of a section of a further serrated slat 10 at a shaped part 11 which is bolted onto the upper end of the side support 3 such as illustrated in FIGS. 3 and 5. The serrated slat sections 9 and 10 engage each other when the fastener 8 is rotated into the locking position such as illustrated in FIG. 6.

In order to mount the hooks 6 for the not illustrated pulling means acting thereupon to the frame holder 5, ledges 12 of a U-shaped cross-section formed integrally with the hooks 6 are riveted onto the upper and lower end of the frame holder. A pivot axle 13 extends through the ledge 12 and the frame holder 5 at the upper end, around which the fastener 8 is pivotable between the open position according to FIG. 5 and the locked position according to FIG. 6.

The fastener includes a lever pair consisting of levers 14 and 15 having the same design and arranged in parallel to each other and which are pivotable around the pivot axis 13. Close to the other end facing away from the pivot axis 13 the operating lever 17 is povotably hinged to the lever pair 14, 15 by means of a further axis 16. The operating lever, which is designed as a hollow rod, includes at opposite sides a respective elongate hole 18 through which the axis 16 projects such that the operating lever 17 is not only pivotable around the axis 16 but is also longitudinally displaceable due to the elongate hole 18. A reduced bolt 19 is located in the hollow rod 17 forming the operating lever and the axis 16 extends therethrough such that the bolt 19 is pivotable around this axis 16 together with the hollow rod 17. A nut 21 is screwed onto the threaded end 20 of the bolt 19, which nut 21 fits into the hollow rod 17. The hollow rod 17 is a square tube into which a smaller square tube piece 22 fits which is riveted to the hollow rod 17 and accordingly forms an inner collar located fixedly in the hollow rod 17 and through which the bolt 19 extends. One end of a pressure spring 23 rests against the inner collar 22 of which the other end rests against the nut 21. This pressure spring 23 is mounted in a strongly pre-stressed condition such that it is pressed together to about 4/5 of the pitch of the spring. Accordingly, in the unlocked state of the fastener in accordance with FIGS. 2, 3 and 5 the operating lever 17 is displaced laterally relative to the axis 16 as far as it is made possible by the elongate hole 18 formed in the operating lever 17, which elongate hole rests with its right hand edge, due to the pre-stressed pressure spring, against the axis 16 such as illustrated in FIGS. 2–5. The advatage of the strongly pre-stressed pressure spring 23 is that if the fastener is rotated into the locking position according to FIG. 6 a large spring force is exerted for maintaining the fastener in the locked position, for which only a very small pitch of the spring is necessary. The extent of the pre-stressing of the pressure spring 23 can, furthermore, be adjusted by rotating the nut 21.

The operating lever 17 includes at its forward end, in the drawing the left end a push button 24 in form of a bolt shaped at its front as a wedge which is riveted into the hollow rod 17. A groove-shaped detent 25 for the push button 24 is formed in the profile piece 11 screwed onto the side support 3 of the frame which button rests in this detent in the locking position of the fastener according to FIG. 6. When the operating lever 17 attains the locked state it will be displaced somewhat towards the right against the action of the somewhat still further compressed pressure spring 23 such that the elongate hole 18 in the operating lever does no longer rest by its right edge against the axis. Because the axis, upon a rotating of the fastener into this locking position, will come to be located below a line connecting the axis 16 with the detent 25, the operating lever is in an over dead center position, and the serrated slat sections 9 and 10 on the frame holder 5 and the side support 3 are pressed together at a high force.

In order that the operating lever with its push button, which lever is pivotably mounted to the lever pair 14, 15 by means of the axis 16, may be guided quickly and safely into the detent 15 upon the rotating into the locking position, the angle of tranverse of the operating lever 17 is limited against the lever pair 14, 15. To this end a pin 26 is provided which extends through the bolt 19, which projects at both sides outwards at the opposite sides of the operating lever 17 through a larger bore 27, whereby the larger bore allows the relative movement between the bolt 19 and the operating lever 17. This pin 26 cooperates with an end edge projection 28 formed at the end of both of the levers 14, 15 and acting as an abutment and limiting the pivotability of the operating lever 17 against the lever pair 14, 15, such as illustrated in FIG. 3.

FIG. 5 illustrates the fastener in a position prior to the coupling of heddle frame and frame holder, but also the final position at the uncoupling. The side support 3 having a U-shaped cross-section includes two legs which extend in the same plane in which the levers 14 and 15 of the lever pair extend. The legs of the side support 3 are curvilinearly cut at their upper ends so that a small area **3*a* of the leg projects further upwards. The two levers 14 and 15 will rest against this area of the two legs of the side support by a lever corner located at the bottom in the open position of the fastener according to FIG. 5, such that the frame holder, upon the rotation of the levers 14 and 15 into the position according to FIG. 5, is urged away from the side support 3, whereby the mutual engagement of the serrated slat sections 9 and 10 is undone. This measure simplifies the seperation of the frame holder from the heddle frame. Due to the projecting area 3*a* at the legs of the side support 3, the levers 14 and 15 are unlatched at the edge such that the levers 14 and 15 can be rotated into the locking position according to FIG. 6**.

Figure 10:
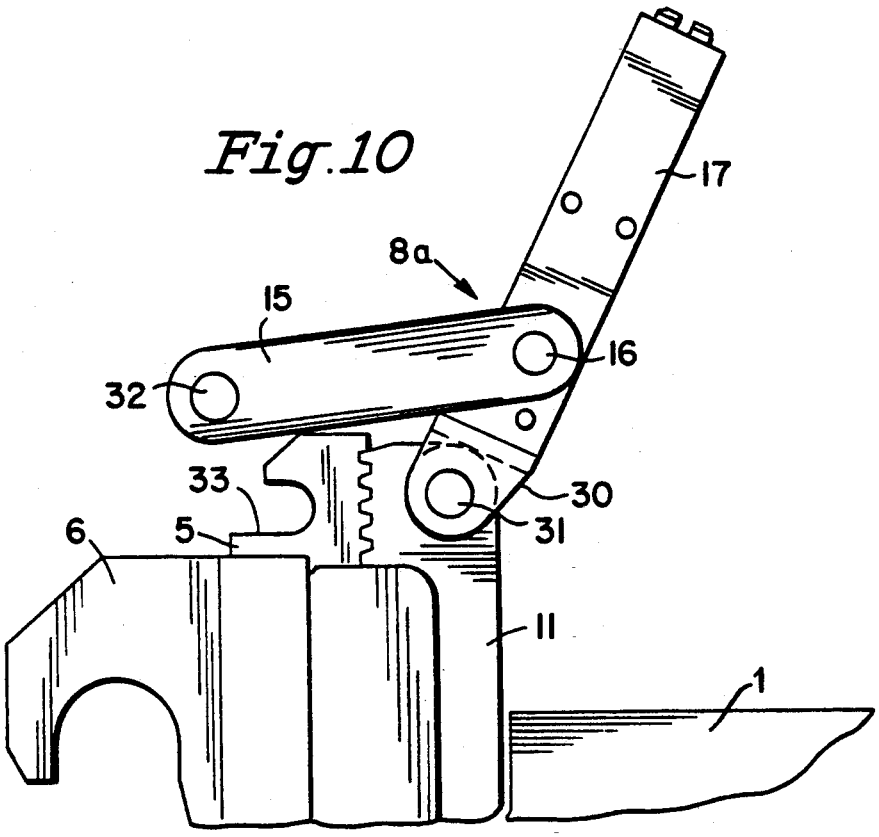
FIG. 10 is a view of the apparatus according to FIG. 8 in the opened position.

According to a modification of the embodiment according to FIGS. 8 to 10 the fastener 8*a* is pivotably mounted to the heddle frame, and specifically to the shaped part 11 mounted at the top of the side support 3 of the heddle frame which supports the serrated slat section 10. This shaped part 11 extends up to between the two levers 14 and 15 of the lever pair. The operating lever includes, such as in the case of the first embodiment, a hollow rod 17 and a bolt 19 extending therein along its longitudinal axis. A forked part 30 is mounted to the end of the hollow rod 17 facing the side support 3, which is pivotably supported in the shaped part 11 by means of a pivot pin 31. Similar to the design of the first embodiment, the lever pair consisting of the levers 14 and 15 is pivotably hinged at the operating lever 17, 19 by means of an axis 16, whereby the other ends of the two levers 14 and 15 are interconnected by a lateral bolt 32. A recess 33 is formed at the upper end of the frame holder 5 and the lateral bolt 32 engages then in this recess when the fastener 8*a* is brought into the locking position. The operational process inside of the operating lever 17, 19 is here opposite to the operational process of the first embodiment, i.e. when the operating lever is rotated into the over dead-center position the bolt 19 moves within the elongate holes 18 in the hollow rod 17, whereby the pre-stressed pressure spring 23 is pressed further together. The two embodiments correspond otherwise and corresponding parts are identified by the same reference numerals.

The frame holder 5 is suitably mounted at its one end by means of the initially mentioned jaw 7 by engaging behind the side support 3 to the heddle frame, and suitably the connection between the frame holder and the heddle frame and the other end of the frame holder is achieved by a fastener operating in accordance with the toggle lever principle. However, an embodiment is also possible according to which a fastener operating in accordance with the toggle lever principle is located at the upper and at the lower end of the frame holder.

Figure 11:
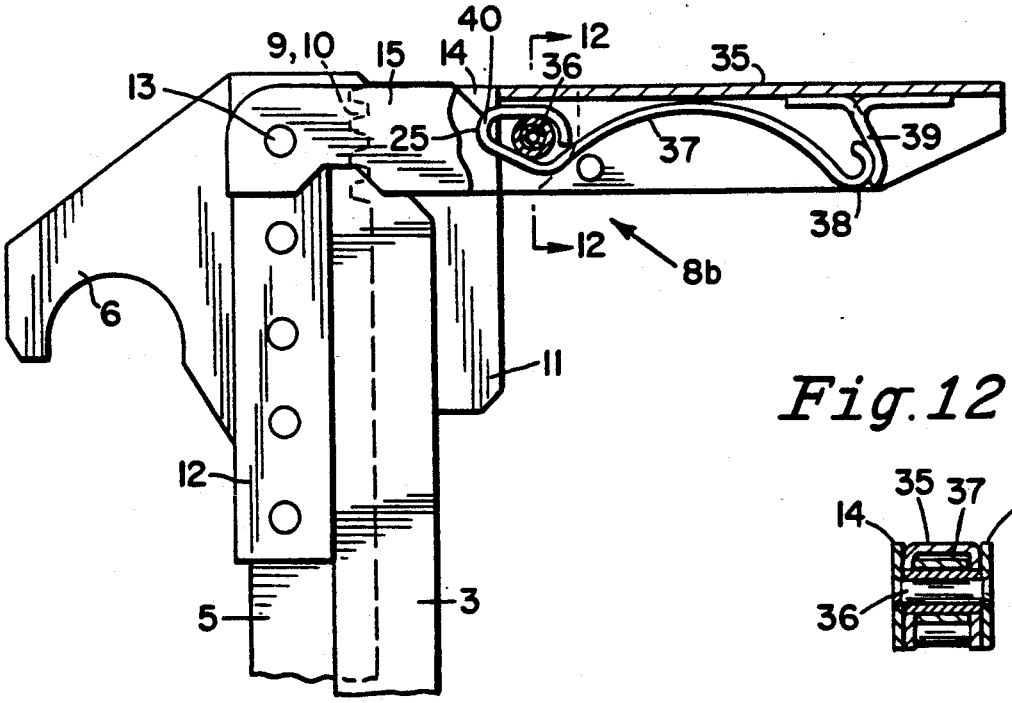
FIG. 11 illustrates a further embodiment of the apparatus partly as a side view and partly in a vertical section.
Figure 12:
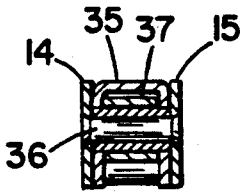
FIG. 12 is a cross-section through the apparatus along line 11—11 of FIG. 11.

According to a further modified embodiment according to FIGS. 11 and 12, regarding its design a substantially simpler operating lever 35 is made with a U-shaped cross-section and, consists therefore of one part only and is mounted via a shaft 36 extending through both legs of the U-shaped lever to two levers 14 and 15 contacting flatly its outside surface, and which are hinged at their opposite end by means of the pivot axis 13 to the frame holder 5. With regard to this lever pair 14, 15 and the pivotable mounting, this embodiment corresponds to the one according to FIGS. 6 and 7. A leaf spring 37 is located in this operating lever 35 of a U-shaped cross-section, which extends in the longitudinal direction thereof and is domed upwards in its lateral direction. The one bent end 38 of this leaf spring 37 rests against an abutment mounted in the operating lever 35. The other end of the leaf spring is bent back for forming a loop shaped end piece 40, and the shaft 36, for the connection of the operating lever 35 to the lever pair 14, 15, extends through this loop shaped end piece 40. This end piece thus forms a push button projecting out of the end of the operating lever 35, which is similar to the embodiment according to FIGS. 6 and 7 and is pressed into a detent recess 25 which is formed in the profile piece 11 bolted to the side support 3 of the heddle frame. By means of the simpler structured fastener 8*b* the same effect is arrived at as present in the previously disclosed embodiments.

While there are shown and described present preferred embodiments of the invention it is to be distinctly understood that the invention is not limited thereto but may be otherwise variously embodied and practiced within the scope of the following claims.

I claim:

1. An apparatus for coupling a heddle frame to respective frame holders each extending along the side of side supports of the heddle frame and movable upwards and downwards and arrestable by application of the toggle lever principle, in which a lock pivotably mounted to an end of the frame holder or an edge of the heddle frame includes an operating lever containing a spring and a lever connecting member pivotably mounted to said operating lever and engaging said frame holder, which operating lever and lever connecting member define a lever pair and are pivotable upon tensioning of said spring according to the toggle lever principle into an over-center position in which they keep form locking coupling members that are present at the frame holder and the side support of the frame stave and that are pressed together by a spring force acting perpendicularly relative to the up and down movement of said frame holder, wherein said operating lever comprises two parts which are guided in each other and are moveable relative to each other against the action of the spring, of which one part is pivotably mounted to said lever connecting member engaging the frame holder and the other part is pressed against the side support of the frame stave with the pressure force of the spring when the operating lever serving an handle is pivoted into the over-center position.

2. The apparatus of claim 1, wherein one of the parts of the operating lever is a hollow rod and the other part is a bolt extending inside of the hollow rod along its longitudinal axis, which bolt is pivotably hinged to the lever pair by means of an axis around which axis the hollow rod supported thereupon by elongate holes is also pivotable, and in that the hollow rod and the bolt are longitudinally displaceable against each other against the action of the spring resting against an inner collar of the hollow rod as well as against a nut screwed onto the end of the bolt due to the elongate holes, in order to be able to pivot the operating lever into the over dead center position.

3. The apparatus of claim 2, wherein a pin projecting laterally from the hollow rod and including means for cooperating with an end edge projection at the levers of the lever pair forms an abutment for limiting angular movement of said operating lever.

4. The apparatus of claim 2, wherein said spring is pre-stressed to about 4/5 of its pitch and this pre-stress is adjustable by means of said nut.

5. The apparatus of claim 2, wherein the fastener including the operating lever and the lever pair is privotably mounted by the two levers of the lever pair at the end of the frame holder and wherein the hollow rod of the operating lever comprises a wedge shaped push bottom at the end facing the side support which is pressed in the over dead center position of the operating lever by the action of the pressure spring located in the operating lever in a detent formed at the side support.

6. The apparatus of claim 5, wherein the levers of the lever pair which are pivotably mounted to the end of the frame holder having a rectangular cross-section are located in the plane of the two legs of the side support having a U-shaped cross-section between which two legs the frame holder project into, and wherein the ends of the levers come to rest in a pivot position of the unlocked fastener against leg areas of said legs of the side support such that the frame holder and the side support are urged away from each other by the rotating movement into said pivot position.

7. The apparatus of claim 2, wherein the fastener which includes the operating lever and the lever pair is hinged with the end of the hollow rod of the operating lever by means of a pivot pin to a part of the heddle frame extending between the two levers, and wherein the two levers of the lever pair which are linked by one of their ends to the operating lever are interconnected at their other end by a lateral bolt which engages into a recess at the end of the frame holder such that by action of the spring located in the operating lever the operating lever of the frame holder is held pressed against the heddle frame in the over dead center position of the operating lever.

8. An apparatus for coupling a heddle frame to respective frame holders each extending along the side of side supports of the heddle frame and movable upwards and downwards and arrestable by application of the toggle lever principle, in which a lock pivotably mounted to an end of the frame holder or an edge of the heddle frame includes an operating lever containing a spring and lever connecting member pivotably mounted to said operating lever and engaging said frame holder, which operating lever and lever connecting member define a lever pair and are pivotable upon tensioning of said spring according to the toggle lever principle into an over-center position in which they keep from locking coupling members that are present at a frame holder and the side support of the frame stave and that are pressed together by a spring force acting perpendicularly relative to the up and down movement of said frame holder, wherein said lever connecting member is a lever pair including two parallel levers located at opposite sides of the frame holder and at opposite sides of the operating lever and contacting the operating lever, which lever pair is pivotably mounted at one end of the operating lever and engages at the other end of the frame holder.

9. An apparatus for coupling a heddle frame to respective frame holders each extending along the side of side supports of the heddle frame and movable upwards and downwards and arrestable by application of the toggle lever principle, in which a lock pivotably mounted to an end of the frame holder or an edge of the heddle frame includes an operating lever containing a spring and a lever connecting member pivotably mounted to said operating lever and engaging said frame holder, which operating lever and lever connecting member define a lever pair and are pivotable upon tensioning of said spring according to the toggle lever principle into an over-center position in which they keep from locking coupling members that are present at the frame holder and the side support of the frame stave and that are pressed together by a spring force acting perpendicularly relative to the up and down movement of said frame holder, wherein a one piece operating lever mounted pivotably to the lever interconnecting member acting onto the frame holder includes a leaf spring extending longitudinally within the operating lever and domed in the lateral direction and which is elastic in one direction and having a bent back end which rests inside the lever at one of its ends and of which the other end which is bent back to form a loop forms a push bottom projecting out of the other end of the lever, which push bottom which is held in the over dead center position of the operating lever under the action of the pressure force caused by the shortening of the spring pressed into a detent recess formed in one side support of the heddle frame.

10. The apparatus of claim 9, wherein said operating lever is hingedly mounted to the lever connecting member consisting of two parallel levers and engaging the frame holder by means of the shaft extending through the end of the spring bent back to form the looplike end piece and forming the push button.

11. The apparatus of claim 9, wherein the areas at the frame holder and at the side support of the heddle frame each have driver surfaces extending laterally relative to the direction of drive of the oscillatingly moved frame holder and located between the two levers of the lever pairs, wherein the driver surfaces are in engagement when the fastener is in its locked position and are pressed towards each other under action of the pressure spring of the operating lever when the operating lever is rotated into the over dead center position.

12. The apparatus of claim 11, wherein the areas of the frame holder and the side support having driver surfaces are serrated slat sections for mutual engagement.

* * * * *